106-83 AU 113 EX
9/5/78 XR 4,112,144

United States Patent [19] [11] 4,112,144
Ellis [45] Sep. 5, 1978

[54] SURFACE TREATMENT OF FIBROUS SUBSTANCES

[76] Inventor: Michael W. Ellis, 1208 W. Mountain, Ft. Collins, Colo. 80521

[21] Appl. No.: 702,510

[22] Filed: Jul. 6, 1976

[51] Int. Cl.[2] ..... B05D 3/08

[52] U.S. Cl. ..... 427/223; 106/10; 106/31; 106/34; 106/83; 106/272; 144/309 F; 144/309 Y; 144/309 Z; 427/274; 427/358; 427/368; 427/369; 427/397; 427/416

[58] Field of Search ..... 427/223, 325, 274, 224, 427/416, 358, 369, 397, 368; 106/10, 31, 83, 272, 34; 428/537, 485, 452, 454; 144/309 F, 309 Y, 309 Z

[56] References Cited

U.S. PATENT DOCUMENTS

| | | | |
|---|---|---|---|
| Re. 13,952 | 7/1915 | Marr | 428/485 |
| 152,572 | 6/1874 | Munger | 106/272 |
| 215,162 | 5/1879 | Rice | 428/485 |
| 1,121,646 | 12/1914 | Marr | 428/485 |
| 1,574,662 | 2/1926 | Leedom | 427/223 |
| 1,595,392 | 8/1926 | Ferguson | 427/274 |
| 1,648,295 | 11/1927 | Coolidge | 428/485 |
| 1,758,336 | 5/1930 | Schmid | 427/223 |
| 1,766,878 | 6/1930 | Campbell | 427/274 |
| 1,903,342 | 4/1933 | Rabak | 428/485 |
| 2,559,398 | 7/1951 | Capell | 106/272 |
| 2,632,710 | 3/1953 | Mayers | 106/34 |
| 2,681,274 | 6/1954 | Young | 106/272 |
| 2,746,873 | 5/1956 | Mayers | 106/34 |
| 2,820,711 | 1/1958 | Kichler et al. | 106/34 |
| 3,035,926 | 5/1962 | Larrico | 106/272 |
| 3,081,159 | 3/1963 | Brown | 427/274 |

FOREIGN PATENT DOCUMENTS

| | | | |
|---|---|---|---|
| 374,437 | 6/1962 | Japan | 427/223 |

*Primary Examiner*—Ronald H. Smith
*Assistant Examiner*—Janyce A. Bell
*Attorney, Agent, or Firm*—Hugh H. Drake

[57] ABSTRACT

To simulate the appearance of weathered wood, newer wood is treated with a compound that includes the combination of a first part of an oil-type carrier, a second part of rotten stone and a third part of wax. A surface of the wood is first subjected to a blackening procedure as by burning or dipping in a suitable stain. The surface is then treated with the compound. Thereafter, highlights are developed in the surface by scraping and/or buffing. A somewhat less-aged look also is obtained by suitably staining rough-sawed lumber.

12 Claims, No Drawings

SURFACE TREATMENT OF FIBROUS SUBSTANCES

The present invention pertains to the surface treatment of fibrous substances such as wood. More particularly, it relates to a suitable compound and to methods of treatment.

Particularly in the interior decoration of enclosed spaces in residential and office facilities, weathered wood has become an attractive commodity. Old barns and other ranch or farm buildings have been salvaged as a source of such wood. Generally, such wood features a weather-roughened appearance and it usually is at least somewhat of a grayish color.

Of course, any demand for a naturally-evolved product leads to consideration of artificially simulating such a product. Observation of the prior art reveals that numerous techniques have heretofor been suggested for modifying the surface characteristics of materials such as wood. For example, wood surfaces have been subjected to burning and wire brushing in order to both enhance coloring and bring out desired surface conformation. A number of prior techniques include acid or alkali washing and buffing steps. Wax has been applied to bring out a desired sheen or other effect. In many of these procedures, a laquer varnish is applied as a final step; however, that often leaves a too-finished surface to accommodate any desire for a rustic appearance.

In connection with such surface treatment, various fillers have been employed. For the most part, the approach has been to obtain a comparatively smooth finish, a type of finishing unlike that which would be desired in the achievement of the appearance of weathered wood. In seeking such smooth finishes, different abrasive materials, including rotten stone, have been employed.

Examples of such prior art are as follows:

U.S. Pat. No. 749,004 — Wadamori
U.S. Pat. No. 764,872 — Stewart
U.S. Pat. No. 1,431,917 — Antaramian
U.S. Pat. No. 1,566,985 — Shuler
U.S. Pat. No. 1,758,336 — Schmid
U.S. Pat. No. 1,802,069 — Schmid
U.S. Pat. No. 2,024,257 — Snelling
U.S. Pat. No. 2,431,148 — Stover
U.S. Pat. No. 2,617,223 — McElroy et al.
U.S. Pat. No. 2,634,534 — Brown
U.S. Pat. No. 2,635,653 — Hennell
U.S. Pat. No. 2,706,355 — Brown
U.S. Pat. No. 2,908,590 — Norris
U.S. Pat. No. 3,061,457 — Brown
U.S. Pat. No. 3,081,159 — Brown
U.S. Pat. No. 3,450,554 — Watson With particular regard to the production of weathered wood, the above-listed Schmid patents include reference to such an objective. However, the processes therein described go no farther than surface burning and brushing. To be sure, that assists in bringing out desired grain. However, the ultimate effect is deficient in total achievement. Moreover, Schmid, and others of the prior art, appear to be directed to the production of sheet-like panels instead of anything resembling true weathered-wood boards or planks.

It is, accordingly, a general object of the present invention to provide a new and improved compound useful in the treatment of fibrous substances, such as wood, for producing a desired effect.

Another object of the present invention is to provide a new and improved method for manufacturing the same.

A further object of the present invention is to provide both a method and a compound which enable the economical achievement of that which simulates weathered wood.

Still another object of the present invention is to provide a new and improved method of simulating an appearance of only partially-complete weathering.

For use in the surface treatment of fibrous substances, one aspect of the invention involves a compound that has a composition which, by volume, includes a first part of an oil-type carrier or vehicle, a second part of rotten stone and a third part of wax. As one method of treating the surface of a fibrous substance, the invention includes the steps of subjecting that surface to a blackening procedure, treating the subjected surface with a compound that includes rotten stone and wax and developing highlights in the treated surface. A related method involves a blackening procedure applied to rough-sawn new lumber.

The features of the present invention which are believed to be novel are set forth with particularity in the appended claims. The organization and manner of operation of the invention, together with further objects and advantages thereof, may best be understood by reference to the following description.

To begin with, a suitable raw lumber is selected. For greatest effectiveness, the lumber chosen is a wood that is comparatively porous. Particularly suitable are woods such as soft pine, pecky cypress and cedar. At least the major surface of the wood to be exposed in use is rough; that is, it has not been subjected to planing, sanding or the like. Ideally in this respect, the wood is simply in what is known as rough-cut or rough-sawn form. That is the usual form of lumber as it comes from the initial or primary cutting operation and before being subjected to any kind of planing or other smoothing step.

Thus, the lumber surface is significantly rough in both feel and visual appearance. For convenience of subsequent installation, the wood may be of a standard size such as a cross section nominally of 1 by 6 or 8 inches. Similarly, it may be provided in one or more of standard lengths such as 6, 8 or 10 feet.

Should the wood selected, nevertheless, have a comparatively smooth surface, that surface is first roughened. To that end, the surface may be subjected to the action of a power-driven wire brush. With many varieties of wood, the grain may be raised by applying water liberally to the surface and then allowing the wood to dry. Another approach is to burn the wood lightly, as by using a gas torch, and thereafter stroking the wood along the direction of the grain with a wire brush of the like. Moreover, a combination of these different roughening techniques may be employed to obtain a variation in appearance. Generally, mere raising of the grain does not fully simulate the natural look of lumber that actually is in rough-sawn form.

However the roughened surface is obtained, it is next subjected to a blackening procedure. To that end, the surface may be rather thoroughly burned. Machines have heretofore been developed for that purpose, although the task may be accomplished by hand and with the use of a torch. After the burning, the surface is wire brushed sufficiently to remove all loose particles. This burning operation may be combined with the previously-mentioned use of burning for the purpose of increasing the roughness of the surface.

Preferably, however, the blackening procedure is carried out by subjecting the surface to a black-pigmented liquid stain. Any stain of the transparent-base type is useful. It is preferred to use one of the water-based latex kind. Several manufacturers provide stains of this kind. One suitable such stain is manufactured under the Diamond Bogel brand and styled by the term "Country Rustic". It is made up of a composition of lampblack, silica, calcium carbonate and acrylic in addition to the vehicle. For use in the present blackening procedure, however, these commercially available stains are substantially diluted in a ratio by volume of six parts water to one part of the commercial stain. With any particular stain solution, of course, the amount of dilution may be adjusted in accordance with the best objective with respect to the ultimate amount of blackening desired for any particular wood. The stain solution preferably is applied by dipping the lumber, or at least the flat surface to be exposed, in a vat of the solution. Alternatively, however, the stain may be applied to one piece at a time by spraying or with a brush or rag. In any case, the stain solution is then permitted to dry. For the type solution described, drying ordinarily takes between 15 and 20 minutes.

Following the blackening procedure, at least the surface to be exposed is treated with a compound that includes an oil-type carrier, rotten stone and wax. The compound may be applied with a brush or rag, by spraying or by dipping. In the case of the latter, only the surface to be exposed need be dipped into the surface of the compound, although the entire board may be immersed if desired.

In any event, the compound preferably is applied liberally so as to get into all cracks thoroughly. After treatment with the compound, the board is permitted either to air dry or is subjected to forced drying by blowing heated or unheated air against the surface. Usually, such drying takes 30–40 minutes.

In order most desirably to simulate the appearance of typical weathered barnwood, the compound in itself is composed of approximately equal parts of the carrier, rotten stone and wax together with a substantially lesser proportion of lampblack or carbon black. The presently preferred carrier is mineral spirits. However, other carriers are contemplated, including those derived from vegetable products. In a particular example, the compound was composed, by volume, of 4 gallons mineral spirits, 4 gallons rotten stone, 4 gallons wax and five ounces of lampblack. Where the user, nevertheless, desires a more brown ultimate appearance of the surface, the lampblack may be omitted. An even deeper brown appearance may be achieved by using only one-half of the mineral spirits and the rotten stone.

Rotten stone is a commercially available material which is in the form of a pumice-like extremely fine powder. A typical composition by weight and in percentages is 60.65 silica, 8.62 alkali, 17.68 alumina, 9.04 ferric oxide, 1.09 moisture and 2.92 of lime and manganese. Being a finely ground-up rock, the material resembles Portland cement in appearance both as to physical properties and as to color.

A suitable wax may be acquired in either paste or liquid form and desirably is one which tends to afford a slight greenish-brown coloration to the wood. The wax should be of the buffing type which dries reasonably quickly, is relatively free of solvent separation and is capable of being polished readily to a hard but flexible surface. When dry, it should show no sign of whiteness. In themselves, such waxes are well known. They involve a suspension of waxes in a volatile solvent and are intended usually for employment in areas subjected to a high volume of traffic. One such commercially-available wax is sold under the brand "Johnson Traffic Wax" and produced by S. C. Johnson and Son, Inc., of Racine, Wisconsin.

After the compound has dried, the surface to be exposed is then lightly scraped or wire brushed for the purpose of removing any residue that may remain following drying of the compound. Thereafter, the surface is thoroughly buffed with a rag or, preferably, a power-driven buffer. Lamb's wool is the preferred buffing material. The buffing serves to accent the knots and develop depth in the appearance of the grain and other striations. Thus, what may be termed the highlights in the surface are developed.

The foregoing procedures create a wood finished to resemble weathered barnboard. When the wood is selected to have numerous knots and/or other surface-visible features, the end result is very striking. The initial blackening procedure serves to accent the knots and develop the depth of appearance, while the subsequent steps create the so-called weathered look while yet producing a most attractive finish for employment of the wood as paneling, or for use in such items as cabinets, tables, shelves, chests, condiment racks and so forth.

In one application, both the initial blackening material and the treatment compound are packaged for delivery to the user desiring to treat the surface of wood he already has acquired. In another application of the teachings herein, completely treated and finished wood is mass produced and made available to the user through lumber yards and the like. In either case, the appearance of many, many years of aging or weathering can be simulated in a matter of minutes.

As indicated, the surface produced in the manner described is a replica of that of very well-weathered wood. A related product that finds demand is one which represents a weathered but not-so-old look. In this case, the boards exhibit an appearance of having a weather-worn outer layer somewhat transparent to an inner core of the original color that usually is more yellow-brown.

To this latter end, the boards again are obtained in rough sawn form. At least the surface to be exposed in use then is dipped or otherwise treated with a very dilute aqueous solution of a black-pigmented liquid stain of the transparent-base type discussed above. In this case, the normal-strength stain solution is diluted by the addition of between about 10 and 12 parts water, by volume, to one part of the original stain solution. After drying, the boards are ready for use without more.

While particular embodiments of the invention have been described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. For use in the treatment of a significantly rough surface of porous wood to effect a weathered appearance of said surface, a compound having the composition, by volume, of:

between approximately one-half and one part of an oil-type carrier;

between approximately one-half and one part of rotten stone;

and approximately one part of wax.

2. A compound as defined in claim 1 in which said carrier: rotten stone and wax are approximately equal in volume.

3. A compound as defined in claim 1 in which said carrier and rotten stone are each approximately one-half in volume the amount of said wax.

4. A compound as defined in claim 1 in which said carrier is mineral spirits.

5. A compound as defined in claim 1 in which said wax constitutes a plurality of waxes in a volatile solvent.

6. A compound as defined in claim 1 in which said wax, when said compound is dry, exhibits substantially no whiteness.

7. A compound as defined in claim 1 and which further includes a substantially lesser proportion, by volume, of lampblack.

8. A method of treating a significantly rough surface of a porous wood to effect a weathered appearance of said surface, comprising the steps of:

subjecting said surface to a blackening procedure;

applying to said subjected surface a compound having the composition, by volume, of between approximately one-half and one part of an oil-type carrier, between approximately one-half and one part of rotten stone, and approximately one part of wax;

drying said compound applied to said surface;

and thereafter buffing said surface sufficiently to develop highlights therein.

9. A method as defined in claim 8 in which said blackening procedure includes burning said surface and thereafter brushing said surface sufficiently to remove all loose particles.

10. A method as defined in claim 8 in which said blackening procedure includes applying to said surface a black-pigmented transparent-base stain and thereafter drying said surface prior to said applying of said compound.

11. A method as defined in claim 8 in which, between said drying and said buffing, said surface is superficially scraped sufficiently to remove any residue remaining following drying of said compound.

12. A method as defined in claim 8 in which, prior to said blackening procedure, said wood is rough sawn to produce a coarse texture of said surface.

* * * * *